United States Patent [19]

Chesebro, Jr.

[11] 3,995,322

[45] Dec. 7, 1976

[54] CUSHION TOP SOCK

[75] Inventor: Robert E. Chesebro, Jr., Sheboygan, Wis.

[73] Assignee: Wigwam Mills, Inc., Sheboygan, Wis.

[22] Filed: Mar. 22, 1976

[21] Appl. No.: 669,334

[52] U.S. Cl. ..... 2/239; 66/172 E

[51] Int. Cl.[2] ..... A41B 11/00

[58] Field of Search ..... 2/239, 240; 66/172 E, 66/178 A, 183, 184, 202, 194, 185, 186, 198 R

[56] References Cited

UNITED STATES PATENTS

| | | | |
|---|---|---|---|
| 2,144,563 | 1/1939 | Davis | 66/185 X |
| 2,183,862 | 12/1939 | Davis | 66/194 X |
| 3,039,282 | 6/1962 | Hayes | 2/239 X |
| 3,078,697 | 2/1963 | Johnson | 66/172 E X |
| 3,250,095 | 5/1966 | Bird | 66/194 X |
| 3,793,851 | 2/1974 | Thorneburg | 66/194 X |
| 3,796,067 | 3/1974 | East | 66/183 X |

*Primary Examiner*—H. Hampton Hunter
*Attorney, Agent, or Firm*—Bell, Seltzer, Park & Gibson

[57] ABSTRACT

This sock is particularly adapted for use with ski boots and the like and the leg portion is provided with terry loops extending inwardly of the inner surface to provide additional fabric thickness for cushioning the leg of the wearer against chafing by the top and upper edge of the ski boot. The sock is provided with an upper cuff portion of rib knit fabric with elastic yarn incorporated in the upper portion thereof to draw the upper end of the sock inwardly when the sock is relaxed and to aid in maintaining the upper edge of the sock in snug engagement with the leg of the wearer. Color bands are provided at the upper and lower ends of the leg portion to aid in defining the area of the leg portion in which the terry loops are formed.

5 Claims, 5 Drawing Figures

CUSHION TOP SOCK

This invention relates generally to a cushion top sock which is adapted for use with ski boots and the like and more particularly to such a sock in which inwardly extending terry loops are formed on the inner surface of the leg portion to provide additional fabric thickness for cushioning the leg of the wearer against chafing by the top and upper edge of the ski boot.

It is known to provide various types of padding in the leg portion of socks to be worn with ski boots for cushioning the leg of the wearer against chafing by the upper edge of the ski boot. For example, it is known to sew a foamed or sponge material in the leg of a sock. However, the foamed or sponge material is usually so thick and bulky that it interferes with the removal and replacement of the sock and/or the ski boot. Also, the separate operation of sewing of this material to the sock leg increases the cost of producing the sock.

With the foregoing in mind, it is an object of the present invention to provide a cushion top sock for use with ski boots and the like wherein the cushioning material in the leg is provided by terry loops which are formed during the conventional knitting operation so that the cost of manufacture is not materially increased.

In accordance with the present invention, the terry loops extend inwardly of the inner surface of the leg portion of the sock and provide additional fabric thickness for cushioning the leg of the wearer against chafing by the upper portion of the ski boot without increasing the thickness of the leg of the sock beyond that necessary to perform the proper cushioning function. The upper end of the leg of the sock is provided with an upper rib knit cuff portion and elastic yarn is incorporated in the upper one-fourth of the cuff to draw the upper end of the sock inwardly when the sock is relaxed and to aid in maintaining the upper edge of the sock in snug engagement with the leg of the wearer. Color bands are provided at the upper and lower ends of the leg portion of the sock to define the area of the leg of the sock which is provided with the additional terry loops forming the additional fabric thickness for cushioning the leg of the wearer. The sock of the present invention may be knit on a conventional type of knitting machine without requiring any substantial modification thereof.

Other objects and advantages will appear as the description proceeds when taken in connection with the accompanying drawings, in which FIG. 1 is a side elevational view of the sock in relaxed and substantially flattened condition and with a portion of the leg broken away to illustrate the terry loops on the inside thereof;

Figure 1:
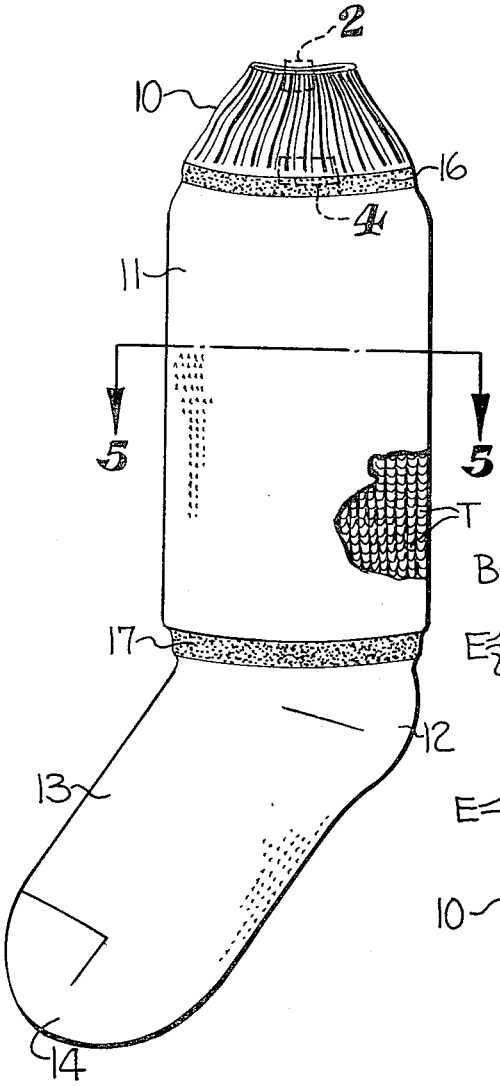

As illustrated in FIG. 1, the cushion top sock of the present invention includes an upper cuff portion 10, a leg portion 11, a heel portion 12, a foot portion 13, and and a toe portion 14. The sock is illustrated in FIG. 1 as including reciprocatorily knit heel and toe pockets 12, 13, however, it is to be understood that the foot portion 13 could be knit straight to form a "tube" sock.

Figure 2:
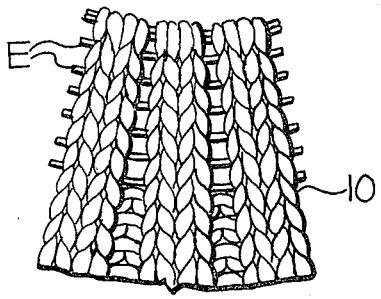
FIG. 2 is a greatly enlarged fragmentary elevational view of the upper edge portion of the cuff of the sock enclosed in the dotted rectangle 2 in FIG. 1.
Figure 3:
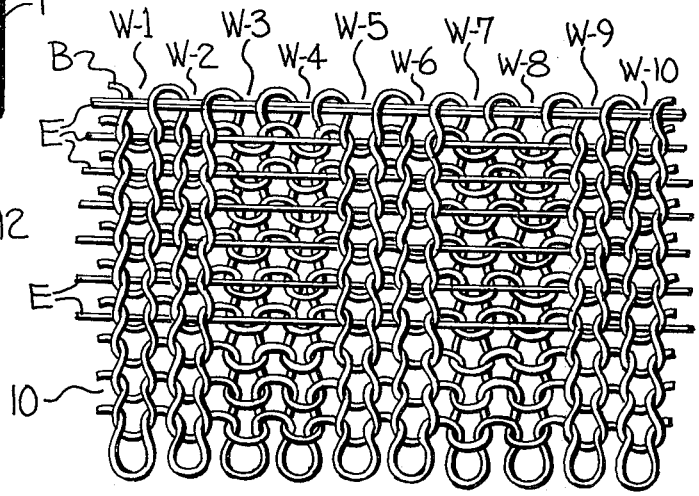
FIG. 3 is a view similar to FIG. 2 but illustrating the fabric in a stretched and somewhat schematic condition to indicate the manner in which the elastic yarn is incorporated in the rib fabric.
Figure 5:
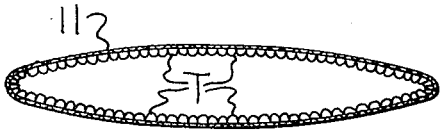
FIG. 5 is a transverse sectional view taken substantially along the line 5—5 in FIG. 1 and illustrating the terry loops extending inwardly from the inner surface of the leg portion.

The upper cuff 10 is formed of rib fabric and is illustrated as being formed in what is known as a 2 × 2 rib with the stitch loops in wales W-1, W-2, W-5, W-6 and W-9 and W-10 in FIG. 3 facing outwardly while the stitch loops in the remaining wales face inwardly. This type of rib fabric is formed in a well-known manner on a circular hosiery knitting machine containing two sets of needles with one set of needles forming the stitch loops facing inwardly and the other set of needles forming the stitch loops facing outwardly. The cuff portion 10 is knit of a body yarn B which forms stitch loops in wales of successive courses and an elastic yarn E is incorporated in the courses in the upper one-fourth of the cuff 10. The elastic yarn E is illustrated in FIG.3 as being inlaid in each of the courses, however, it is to be understood that the elastic yarn E could be incorporated by knitting it with the body yarn, if desired. As best illustrated in FIGS. 1 and 2, the elastic yarn incorporated in the upper portion of the cuff 10 draws the fabric inwardly so that the wales containing the outwardly facing stitch loops are drawn together when the sock is relaxed and the elastic yarn E causes the upper end of the sock to be maintained in snug engagement with the leg when the sock is worn.

Figure 4:
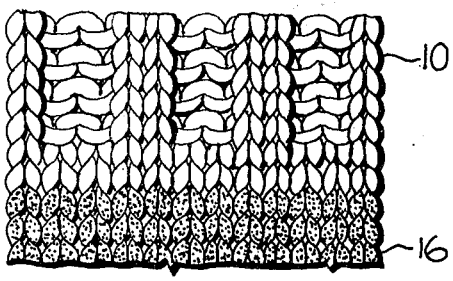
FIG. 4 is an enlarged fragmentary elevational view of an area of the relaxed fabric at the lower edge of the cuff enclosed in the dotted rectangle 4 in FIG. 1.

Below the cuff 10, a first or upper color band 16 may be formed by changing the color of the body yarn used to knit the cuff portion. The color band 16 may be knit any desired width but it is preferably about four courses wide. As is indicated in the lower portion of FIG. 4, the leg portion 11 and the remainder of the sock is knit on one set of needles to form a plain jersey knit or non-rib fabric with all of the stitch loops in every wale facing outwardly of the sock.

Immediately below the color band 16, the leg portion 11 is knit with the body yarn and an additional terry yarn which forms terry loops T extending inwardly of the inner surface of the leg portion to provide additional fabric thickness in the leg portion for cushioning the leg of the wearer against chafing by the top and upper edge of the ski boot. At the lower end of the leg portion 11, another color band 17 may be formed so that the upper and lower color bands 16, 17 provide a visual indication of the area of the leg portion of the sock which is provided with the terry loops and which forms the cushion against the leg of the wearer. The heel 12, foot 13 and toe 14 are preferably plain knit with the body yarn only.

Although the length of the leg portion 11 may be varied to accommodate ski boots of various heights, it is preferred that the leg portion 11 be somewhat longer than the foot portion 13. It has been found that the cushion top sock will accommodate most various heights of ski boots if the leg portion 11 is knit approximately one-third longer than the foot portion 13.

Thus, the leg portion of the present cushion top sock is provided with additional fabric thickness formed by the terry loops extending inwardly of the inner surface of the leg portion. The terry loops engage the leg of the wearer and cushion the leg against chafing by the top and upper edge of the ski boot.

In the drawings and specification, there has been set forth a preferred embodiment of the invention, and although specific terms are employed, they are used in a generic and descriptive sense only and not for purposes of limitation.

That which is claimed is:

1. A seamless knit sock particularly adapted for use with ski boots and the like comprising a leg portion, an upper cuff portion, and heel and foot portions knit throughout of body yarn, said upper cuff, heel and foot portions being devoid of terry loops, at least that medial area of said leg portion adapted to be engaged by the top and upper edge of the ski boot also being knit with a terry yarn forming terry loops extending inwardly and entirely around the circumference of said leg area to provide additional fabric thickness in said leg area for cushioning the leg of the wearer against chafing by the top and upper edge of the ski boot.

2. A seamless knit sock according to claim 1 wherein said upper cuff portion comprises rib knit fabric.

3. A seamless knit sock according to claim 1 wherein said area of terry loops extends throughout the length of said leg portion, and including first and second color bands knit of a body yarn contrasting in color with the color of the body yarn in the remainder of said sock, said color bands being positioned at the upper and lower ends of said leg portion and defining the area of the leg portion therebetween containing said terry loops.

4. A seamless sock according to claim 2 including elastic yarns incorporated in the upper one-fourth of said upper cuff portion to draw the upper end portion inwardly when the sock is in relaxed condition and to aid in maintaining the upper end of the sock in tight engagement with the leg.

5. A seamless knit sock according to claim 4 wherein said elastic yarn is inlaid in said upper cuff portion.

* * * * *